US006924423B2

(12) United States Patent
O'Donnell

(10) Patent No.: US 6,924,423 B2
(45) Date of Patent: Aug. 2, 2005

(54) SEE SAW DRUMSTICK

(76) Inventor: Richard L. O'Donnell, 142 Willow Brook, St. Louis, MO (US) 63146

( * ) Notice: Subject to any disclaimer, the term of this patent is extended or adjusted under 35 U.S.C. 154(b) by 78 days.

(21) Appl. No.: 10/443,161

(22) Filed: May 22, 2003

(65) Prior Publication Data

US 2004/0231492 A1 Nov. 25, 2004

(51) Int. Cl.[7] ..... G10D 13/02
(52) U.S. Cl. ..... 84/422.4
(58) Field of Search ..... 84/422.4

(56) References Cited

U.S. PATENT DOCUMENTS

| | | | | |
|---|---|---|---|---|
| 1,761,245 A | | 6/1930 | Vitto | |
| 2,040,603 A | * | 5/1936 | Gladstone | 84/422.4 |
| 2,728,257 A | * | 12/1955 | Pochobradsky | 84/422.4 |
| 2,905,043 A | | 11/1959 | Sodenberg | |
| 3,165,964 A | | 1/1965 | Stys et al. | |
| 3,465,635 A | | 9/1969 | Maldacker | |
| 3,688,013 A | | 8/1972 | Menard | |
| 3,866,508 A | | 2/1975 | Huslig | |
| 4,040,323 A | * | 8/1977 | Kline | 84/422.4 |
| 4,114,503 A | | 9/1978 | Petillo | |
| 4,462,296 A | | 7/1984 | Heiskell | |
| 4,476,768 A | | 10/1984 | Willis | |
| 4,488,470 A | | 12/1984 | Larrain | |
| 4,651,617 A | | 3/1987 | Schwartz | |
| 4,719,836 A | | 1/1988 | Baumgart | |
| 5,370,030 A | | 12/1994 | Horne | |
| 5,581,031 A | | 12/1996 | Blankenship, Jr. | |
| 5,696,339 A | | 12/1997 | Brennan | |

* cited by examiner

*Primary Examiner*—Shih-Yung Hsieh
(74) *Attorney, Agent, or Firm*—Douglas E. Warren

(57) ABSTRACT

The present invention relates to a drumstick for striking a percussion instrument in a see saw-like manner. The design of the drumstick allows the percussionist to comfortably grip two drumsticks simultaneously while allowing the percussionist to rapidly strike a percussion instrument in a very rapid manner. The drumstick includes a thin proximate end, a first and second intermediate portions, and a distal end having various embodiment of beating tips.

14 Claims, 2 Drawing Sheets

SEE SAW DRUMSTICK

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

When playing any percussion instrument, the manner in which the striking implement is held in the musician's hands is critical. Additionally, the percussion instrument and the style of music to be played also dictates the type of striking implement to be used. However, for virtually every style of music and every type of percussion instrument, there is always a need for the percussionist to have the capability of striking the percussion instrument as rapidly as possible.

To achieve this goal, a number of innovations have been implemented. In some cases, ordinary drumsticks are used, but the placement of the drumsticks within the percussionist's hands can be varied. For example, the use of four mallets is not unusual for playing a vibraphone or a marimba. When playing a vibraphone, the mallets are held by the percussionist in what is commonly called a Burton grip. When playing a marimba, the mallets are held by the percussionist in what is commonly known as a Musser grip. Both of these grips allow for a quick spreading apart of the mallets to adjust for the interval to be played on the keyboard, and both utilize a bending of the wrist and a rotation of the wrist to execute various strokes. However, neither of these grips works well for playing drums with ordinary drumsticks.

In other cases, drumsticks themselves have been specially designed to meet the specific playing need of the percussionist. Some inventions include variations on the tip of the drumstick to allow for rapid beating, while other inventions include variations to the gripping area of the drumstick to allow for variations in the grip.

Examples of variations on the tip of the drumsticks can be found in a number of patents. U.S. Pat. No. 4,651,617 issued to Schwartz discloses a drumstick having an elongated main body with one striking tip and a second elongated ancillary body having a separate striking tip. The second elongated body is pivotally attached to the first elongated main body and allows the percussionist to execute multiple drum beat rolls. U.S. Pat. No. 3,688,013 issued to Menard discloses a drumstick in the general shape of a pitch fork. The invention includes the addition of two extra tips in conjunction with the single tip at the end of the drumstick body. In a more complicated vein, U.S. Pat. No. 3,465,635 issued to Maldacker shows a drumstick including multiheaded mallets. One of the mallets is fixed while each of the other mallets is adjustable.

Examples of variations to the grip are shown in a number of other patents. U.S. Pat. No. 6,271,451 issued to Gress discloses a drumstick which includes a pivot knob attached to the body of the drumstick. By moving each end of the drumstick around the pivot, the shape of the drumstick changes to allow the percussionist to adjust the grip of the drumstick in various manners and styles. U.S. Pat. No. 6,118,062 issued to Thoman discloses a drumstick having a unique ergonomic grip that allows the percussionist to play a percussion instrument using the drumstick for a long period of time while preventing the percussionist from experiencing unnecessary fatigue, discomfort, or pain. U.S. Pat. No. 6,069,308 issued to Rabb shows a drumstick having a series of ridges that produce sounds different than other drumsticks. The ridges are drawn over an object such as another drumstick or a drum rim to produce the different sounds.

In an effort to provide a drumstick in which the percussionist can adjust the overall balance of the drumstick, U.S. Pat. No. 6,028,260 issued to LaLonde discloses a drumstick having an adjustable weight system incorporated into the interior portion of the drumstick. An interior weight within the drumstick allows the percussionist to move the weight axially toward or away from the playing tip of the drumstick. U.S. Pat. No. 3,859,887 discloses a drumstick having an intermediate adjustment pivot. The pivot can be positioned to allow the drummer the vary the grip of the drumstick. U.S. Pat. No. 4,488,470 shows a drumstick having a series of surface interruptions on the drumstick. These surface interruptions are generally configured to be evenly spaced square grooves on the diameter of the drumstick. These grooves act to provide the percussionist with the ability to keep a firm grip on the drumstick during a performance.

The shape of the drumstick disclosed in U.S. Pat. No. 3,866,508 issued to Huslig includes a flattened area on the drumstick. This allows the percussionist to maintain a more positive and comfortable grip on the drumstick. U.S. Pat. No. 4,719,836 issued to Baumgart shows a drumstick in which recesses have been made in the drumstick handle to allow for the positioning of the various fingers of the hand when the drumstick is being used to play a percussion instrument.

While all of the above inventions are intended to allow the percussionist to have the ability to strike a percussion instrument rapidly, each of these inventions does not allow the percussionist to strike rapidly, while also allowing for a comfortable grip that can be adjusted easily to match the style of music being performed or the particular playing style of the percussionist.

SUMMARY OF THE INVENTION

The present invention overcomes these and other problems by providing a simple drumstick design which allows a percussionist to comfortably hold the drumstick while executing a see saw method of percussion instrument playing.

The present invention resides in a see saw drumstick having a uniquely designed body which allows the percussionist to comfortably grip two of the drumsticks simultaneously. The invention is named "see saw drumstick" in recognition of the see saw-like style of playing that results when the present invention is used when playing a percussion instrument rapidly. When the percussionist is holding two of the drumsticks disclosed by the present invention, the sticks cross at the butt, under the last two fingers, and away from the wrist with the fingers extended downward. When grasped in this manner, the drumsticks allow the wrist to be rotated along the axis of the arm and the motion is transmitted to the sticks from the bottom of the hand as an eccentric fulcrum. The percussionist's wrist is completely relaxed so that the weight of the hand provides the momentum for rotating the drumsticks in a very rapid manner. This relaxed manner of this see saw motion allows long periods of fast playing that are not tiring. It is also possible to play as fast, or faster, with one hand using this technique than can be done by using two hands with a single stick in each hand.

The present drumstick invention is readily adaptable to virtually all types of percussion instruments.

Additional features of the present invention will be in part apparent and in part pointed out hereinafter.

BRIEF DESCRIPTION OF THE SEVERAL VIEWS OF THE DRAWINGS

In the drawings, wherein like numerals and letters refer to like parts wherever they occur.

Corresponding reference characters indicate corresponding parts throughout the several views of the drawings.

While one embodiment of the present invention is illustrated in the above referenced drawings and in the following description, it is understood that the embodiment shown is merely for purpose of illustration and that various changes in construction may be resorted to in the course of manufacture in order that the invention may be utilized to the best advantage according to circumstances which may arise, without in any way departing from the spirit and intention of the invention, which is to be limited only in accordance with the claims contained herein.

DETAILED DESCRIPTION

Detailed Description of the See Saw Drumstick

Figure 1:
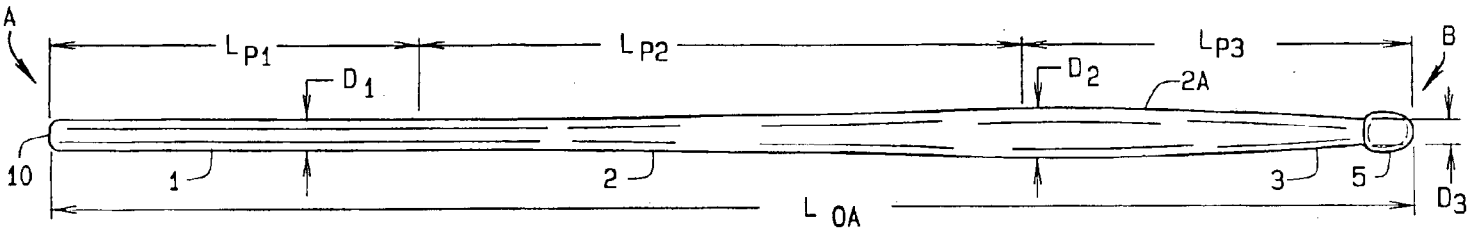
FIG. 1 is a top view of a first embodiment of the present invention.

Referring now to FIG. 1, a see saw drumstick A is shown. The see saw drumstick A includes a proximate end 1, a first intermediate portion 2, and a distal end 3.

The distal end 3 of see saw drumstick A also has a beating tip B. The beating tip B can be of various shapes and styles. The beating tip B may also be made from a variety of materials such as wood, plastic, rubber, wound yarn, felt, leather, and groups of individual wires. FIG. 1 show a beating tip B in the shape of an obround portion 5 of the see saw drumstick A. The obround portion 5 is normally larger than the diameter of the distal end 3, however, the size and shape of the obround portion 5 can be adjusted to fit any particular drumming style or percussion instrument and still remain within the scope of the present invention.

Figure 2:
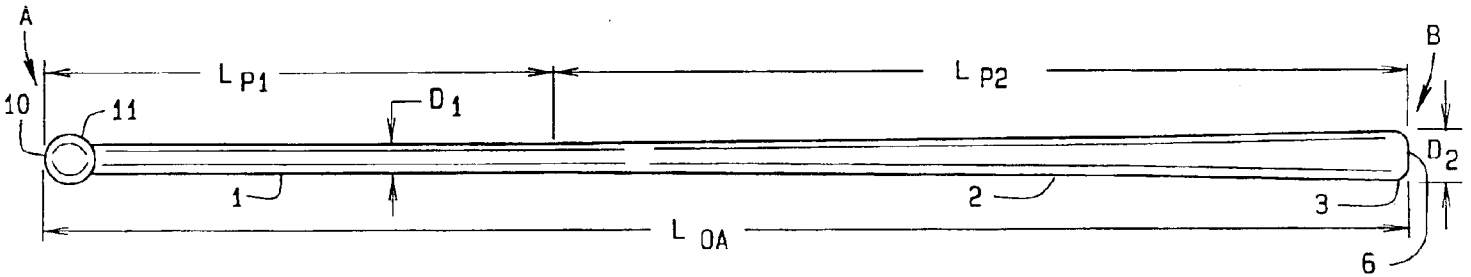
FIG. 2 is a top view of a second embodiment of the present invention.

FIG. 2 shows a see saw drumstick A having an alternative type of beating tip B. Here, the beating tip B is simply an extension of the taper of the distal end 3 of first intermediate portion 2 of the see saw drumstick A. The beating tip 6 has a diameter of from about 0.56 inch to about 0.75 inch, and is rounded on its end edges.

It is noted that the dimensions called for within this specification and the claims may be in either three decimal places, such as 0.375, or in two decimal places, such as 0.37. In either case, the number of decimal places indicated herein for any dimension is not indicative of any allowable tolerances or variances from the indicated dimension, and the full range of dimensional tolerances and variances for each dimension are intended to be disclosed and claimed within the scope of the present invention.

Figure 3:
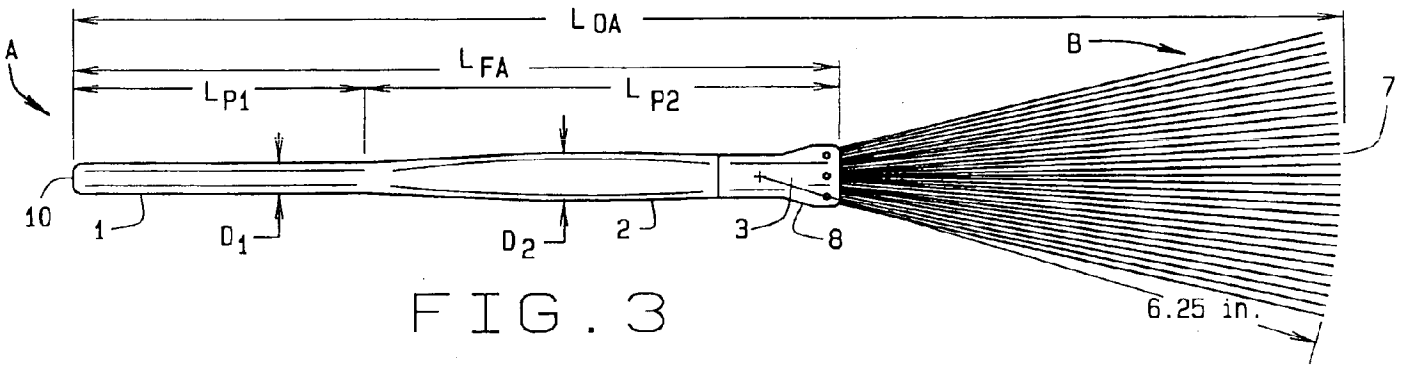
FIG. 3 is a top view of a third embodiment of the present invention.

FIG. 3 shows a third alternative for the beating tip B of the present invention. Instead of a generally rounded or circular beating tip, the distal end 3 of the see saw drumstick A in has a beating tip B that comprises a fanned arrangement of a plurality of thin wires 7. A combination of a drumstick handle and a plurality of thin wires is commonly called a brush. The thin wires 7 are attached to the distal end 3 of the see saw drumstick A by a clamp 8 that is attached to the distal end 3 of the see saw drumstick A while at the same time captivating the plurality of thin wires 7. The clamp 8 holds the plurality of thin wires 7 in a fan-like array in which the angular spacing between each of the individual thin wires is substantially the same. Additionally, the clamp 8 also retains the plurality of thin wires 7 such that the plurality of thin wires are spread along generally the same plane with the plurality of thins wires 7 having an outer radius of about 6.25 inches. The plurality of thin wires 7 may be of any diameter depending upon the flexibility and tonal requirements desired by the percussionist. In the embodiment shown in FIG. 3, there are approximately two hundred individual wires with each wire having a diameter of about 0.010 inch.

In each of the above embodiments, the proximate end 1 of the see saw drumstick A is substantially the same. Specifically, the proximate end 1 has a diameter $D_1$ of between about 0.31 inch and about 0.56 inch. In the embodiments shown in FIG. 1, FIG. 2, and FIG. 3, the diameter $D_1$ of the proximate end 1 is about 0.35 inch. The proximate end 1 has a length $L_{P1}$ of between about 3.50 inches and about 4.50 inches. In the embodiments shown in FIG. 1, FIG. 2, and FIG. 3, the length $L_{P1}$ of the proximate end 1 is about 4.00 inches.

The first intermediate portion 2 has a minimum diameter equal to the diameter $D_1$ of the proximate end 1 and a maximum diameter $D_2$ of between about 0.47 inch and about 0.560 inch. In FIG. 1 and FIG. 3, the length $L_{P2}$ of the first intermediate portion 2 is between about 6.375 inches and about 4.387 inches. In FIG. 2, the length $L_{P2}$ of the first intermediate portion 2 is about 10.50 inches.

In the embodiment of FIG. 1, there is a second intermediate portion 2A of the see saw drumstick A. The second intermediate portion 2A has a maximum diameter equal to the maximum diameter $D_2$ of the first intermediate portion 2 and a minimum diameter $D_3$ of between about 0.22 inch and about 0.33 inch. The length $L_{P3}$ of the second intermediate portion 2A is between about 2.62 inches and about 5.00 inches. In the embodiment of FIG. 1, the minimum diameter $D_3$ is about 0.275 and the length $L_{P3}$ is about 4.12.

It is understood that the embodiments of FIG. 2 and FIG. 3 comprise a generally smooth taper from the smaller diameter $D_1$ of the proximate end 1 of the see saw drumstick A to the diameter $D_2$ first intermediate portion 2 of the see saw drumstick A. It is also understood that the embodiment of FIG. 1 further comprises a generally smooth taper from the smaller diameter $D_3$ of the second intermediate portion 2A of the see saw drumstick A to the diameter $D_2$ of the first intermediate portion 2 of the see saw drumstick A. In fact, the entire length $L_{OA}$ of the see saw drumstick in all embodiments, excluding the beating tips on the distal end 3 of the embodiments of FIGS. 1 and 3, and a knob 11 on the proximate end 1 of the embodiment of FIG. 2, comprises a series of curves which smoothly blend from the proximate end 1 of the see saw drumstick A to the distal end 3.

The overall length of the see saw drum stick A may vary, but is generally between about 13.00 inches and about 15.50 inches. The length of the embodiments of the see saw drumstick A in FIGS. 1 and 2 is about 14.50 inches. The length of the embodiment of the see saw drumstick A in FIG. 3 is about 13.75 inches.

The tip 10 of the proximate end 1 of the see saw drumstick A may be modified in a number of ways and still remain within the scope of the present invention. For example, FIG. 1 and FIG. 3 show the tip 10 as being the same diameter $D_1$ as the proximate end 1. For general comfort in gripping the see saw drumstick A, the tip is rounded on the circumferential edges. In FIG. 2, the tip 10 has a knob 11. The knob 11 has a diameter larger than the diameter $D_1$ of the proximate end 1 and can be as large as 0.62 inch.

As noted above, in each of the embodiments shown, the overall length $L_{OA}$ in FIG. 1 and FIG. 2, and the length $L_{EA}$ of the embodiment of FIG. 3, comprises a series of curves which smoothly blend from the proximate end 1, the first intermediate portion 2, the second intermediate portion 2A (FIG. 1 only), and the distal end 3 into a flowing, continuous curve. However, it is also noted that the lengths $L_{OA}$ and $L_{EA}$ of the see saw drumstick A may also be formed from a discontinuous curve, or may be formed of a combination of curves and non-curved surfaces. Nevertheless, it will be appreciated that the interrelationship between the connections of the individual portions of the see saw drumstick may be varied in any manner as long as the proximate end 1 of the see saw drumstick A retains the features noted above.

Detailed Description of the Use and Operation of the Drumstick.

The traditional single stick per hand grip used by drummers, (not including timpanists or keyboard mallet players), involves the use of both the wrist, (moving up and down like a hinge) and the fingers. The stick is held as an extension of the hand, in line like a forefinger. The stick is pivoted between the thumb and index finger, and the remaining fingers provide sensitive additional control of the stroke. The stick rebound returns the stick and hand to the original starting position. The essential points are that the grip is at the forward part of the hand, and that the fingers magnify the wrist motion.

With the see saw technique of drumming, two sticks per hand are propelled only by the rotation of the wrist along an axis in line with the forearm. The last two fingers are used to grip the crossed sticks and the front two fingers are static and serve as a guide to maintain constant spacing. Thus, the fingers neither provide a fulcrum nor assist in the stroke. This method creates an eccentric fulcrum that allows the motion of the two sticks to reciprocate in an arch in line with the plane of the partially closed fingers, but at an angle of about 45° in relation to the axis of rotation of the forearm. Proper use of this technique utilizes the weight of the hand to assist the stroke. Because of the reciprocal motion, the inertia of each stick is counter balanced by the other stick. This provides an effortless stroke, that is twice as fast as the normal technique.

Figure 4:
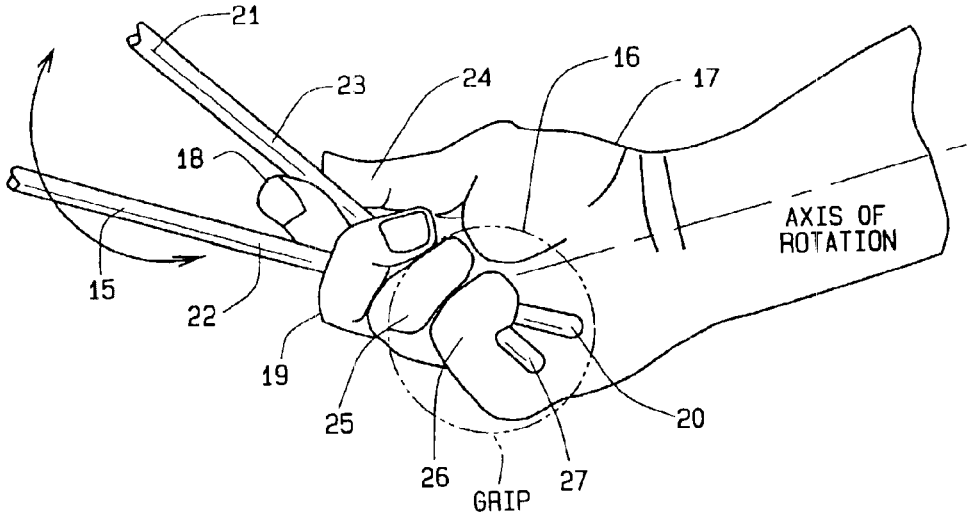
FIG. 4 is a first perspective view of how the present invention is held in the percussionist's hand.
Figure 5:
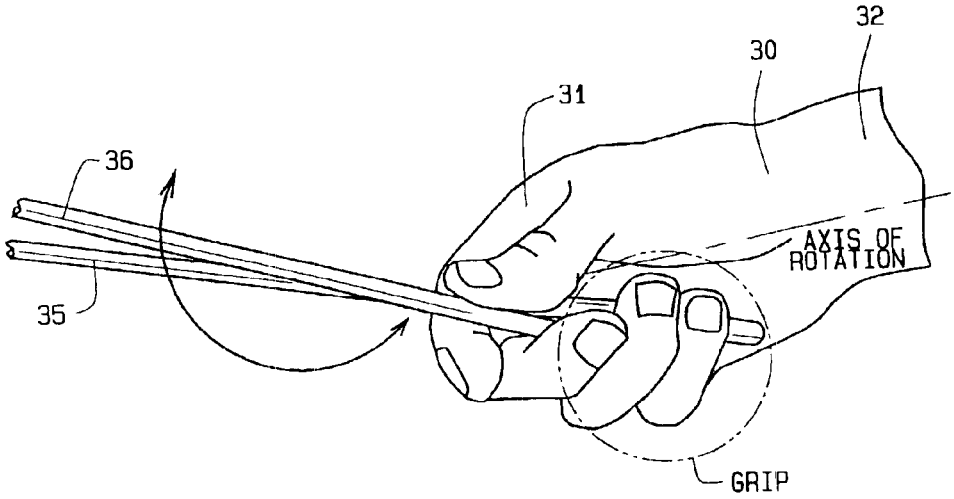
FIG. 5 is a second perspective view of how the present invention is held in the percussionist's hand.

Now, more specifically, FIG. 4 and FIG. 5 depict the grip and method of see saw drumming. FIG. 4 shows a preferred grip used in the see saw method of drumming. A first see saw drumstick 15 is placed in a palm 16 of a percussionist's hand 17. The first intermediate portion 22 of the first see saw drumstick 15 is held between a first finger 18 and a second finger 19 of the percussionist's hand 17, with the proximate end 20 of the first see saw drumstick 15 resting against the palm 16. A second see saw drumstick 21 is placed in the percussionist's hand 17 by locating a proximate end 27 of the second see saw drumstick 21 over the proximate end 20 of the first see saw drumstick 15 thereby placing the first see saw drumstick 15 between the second see saw drumstick 21 and palm 16. The first intermediate portion 23 of the second see saw drumstick 21 is located between a thumb 24 and the first finger 18 of the percussionist's hand 17. The see saw grip is then completed by wrapping a third finger 25 and a fourth finger 26 of the percussionist's hand 17 around the overlapped proximate ends 20 and 27 of the first see saw drumstick 15 and the second see saw drumstick 21.

The seesaw style of drumming performed using the seesaw drumsticks A is shown in FIG. 5. After the see saw grip shown in FIG. 4 has been accomplished, the percussionist is prepared to strike a percussion instrument using the see saw method. An important aspect of the see saw method is the recognition that there is normally very little, of any, movement of the wrist 30. Rather, the general position of the percussionist's hand 31, wrist 30, and forearm 32 does not change. Instead, the hand 31, wrist 30, and forearm 32 are rotated as a single unit around an Axis of Rotation as shown in FIG. 5.

To execute a series of strikes using the see saw method of drumming, the hand 31, wrist 30, and forearm 32 are quickly rotated clockwise around the Axis of Rotation. This action lifts the second see saw drumstick 36 from the striking surface of the percussion instrument (not shown) and lowers the first see saw drumstick 35 to strike the percussion instrument. It is noted that while the first see saw drumstick 35 is striking the percussion instrument, the second see saw drumstick 36 is moved into a preparatory position to allow the second see saw drumstick 36 to strike the percussion instrument when the second part of the see saw drum method is executed. Specifically, this clockwise movement is then quickly followed by an identical counterclockwise movement resulting in the striking of the percussion instrument with the second see saw drumstick 36 while simultaneously lifting the first see saw drumstick 35 to place it in a preparatory position for again striking the percussion instrument. This sequence completes one cycle of the see saw method of drumming. This cycle is repeated as many times are desired by the percussionist and is played by the percussionist at the speed and intensity required by the percussionist's performance.

The combination of the unique design of the see saw drumsticks, the ability to place the see saw drumsticks in the percussionist's hand in such a way that allows the see saw grip to be generated, and the relaxed movement of the percussionist's arm around the Axis of Rotation results in a comfortable grip that enables the percussionist to strike a percussion instrument with extreme rapidity for long period of time without creating undue fatigue in the percussionist's hand and arm. The actual rapidity and force that each of the see saw drumsticks strikes the percussion instrument is adjusted by the percussionist to fulfill the specific musical requirements of the music being performed.

While the above description describes various embodiments of the present invention, it will be clear that the present invention may be otherwise easily adapted to fit any configuration where a drumstick having the ability to allow a percussionist to strike a percussion instrument rapidly may be utilized.

As various changes could be made in the above constructions without departing from the scope of the invention, it is intended that all matter contained in the above description or shown in the accompanying drawings shall be interpreted as illustrative and not in a limiting sense.

What is claimed is:

1. A drumstick comprising:

an elongate member having a generally circular cross-section and having a length of between about 13.00 inches to about 15.50 inches, the elongate member further comprising;

a gripping portion having a generally cylindrical shape with a diameter of between about 0.31 inch and about 0.56 inch and a length of between about 3.50 inches and about 4.50 inches, and a beating portion having a length of between about 9.50 inches and about 11.00 inches having a first end and a second end, the beating portion having the general form of a substantially flattened campanular shaped longitudinal section wherein the high point of the campanular shape is offset toward the second end, the first end having a diameter that matches the diameter of the gripping portion, and the second end terminating in a neck having a diameter of about 0.27 inches, wherein the beating portion has a varying diameter between the first end and the second end such that the diameter of the beating portion increases arcuately and gradually from the first end to the high point of the campanular shape, the diameter of the beating portion at the high point of the campanular shape being between about 0.47 inches and about 0.63 inches, after which the diameter decreases gradually and arcuately until the diameter of the beating portion equals the diameter of the neck on the second end, and wherein the high point of the campanular shape is located between about 5.00 inches and about 10.50 inches from the first end of the beating portion.

2. The drumstick of claim 1 wherein a fanned arrangement of a plurality of thin wires is attached to the neck of the beating portion by a clamp.

3. The drumstick of claim 2 wherein the clamp holds the plurality of thin wires in a fan-like array in which an angular spacing between each of the individual thin wires is substantially the same.

4. The drumstick of claim 3 wherein the clamp also retains the plurality of thin wires such that the plurality of thin wires are spread along generally the same plane with the plurality of thin wires having an outer radius of about 6.25 inches.

5. The drumstick of claim 4 wherein each of the plurality of thin wires has a diameter of between about 0.010 inch and about 0.125 inch.

6. The drumstick of claim 5 wherein the plurality of thin wires includes about two hundred individual wires.

7. The drumstick of claim 6 wherein each of the plurality of wires has a diameter of about 0.010 inch.

8. The drumstick of claim 1 further comprising a substantially obround beating tip with a diameter larger than 0.30 inches and wherein the beating tip is integrally connected with the neck of the beating portion.

9. The drumstick of claim 8 wherein an outer end of the beating tip is smoothly curved.

10. The drumstick of claim 9 wherein the diameter of the gripping end is about 0.35 inch.

11. The drumstick of claim 10 wherein the gripping end has a length $L_{P1}$ of about 4.00 inches.

12. The drumstick of claim 11 wherein the maximum diameter point is located at about 6.38 inches from the first end of the beating portion.

13. The drumstick of claim 12 wherein the the maximum diameter point has a diameter of about 0.540 inch.

14. The beating tip of claim 13 wherein the gripping portion includes a knob, the knob having a diameter larger than the diameter of the gripping portion.

* * * * *